US005427001A

United States Patent [19]

Uchiyama et al.

[11] Patent Number: 5,427,001

[45] Date of Patent: Jun. 27, 1995

[54] METHOD AND APPARATUS FOR MAKING EXTERNAL CUTTING MEMBER OF AN ELECTRIC RAZOR

[75] Inventors: Hiromi Uchiyama; Masaki Okabe, both of Nagano, Japan

[73] Assignee: Izumi Products Company, Nagano, Japan

[21] Appl. No.: 121,988

[22] Filed: Sep. 15, 1993

[51] Int. Cl.[6] ..... B21K 21/00

[52] U.S. Cl. ..... 76/115; 76/116; 76/DIG. 8

[58] Field of Search ..... 76/101.1, 115, 116, 76/DIG. 8; 30/43.6, 43.9, 346.51; 83/861, 880, 886, 887

[56] References Cited

U.S. PATENT DOCUMENTS

| | | | |
|---|---|---|---|
| 2,325,205 | 7/1943 | Molnar | 76/116 |
| 3,116,551 | 1/1964 | Anton | 30/43.6 |
| 3,130,609 | 4/1964 | Wahl | 76/101.1 |
| 3,261,091 | 7/1966 | Van Den Driest | 30/43.6 |

FOREIGN PATENT DOCUMENTS

| | | |
|---|---|---|
| 0566234 | 10/1993 | European Pat. Off. . |
| 894660 | 1/1945 | France . |
| 895433 | 1/1945 | France . |
| 1048775 | 12/1953 | France . |

*Primary Examiner*—Hwei Siu Payer
*Attorney, Agent, or Firm*—Koda and Androlia

[57] ABSTRACT

Method and apparatus for opening slits of uneven lengths in the concentric circular shaving sections of an external cutting member that is used in an electric razor using a rotary cutter that cuts the shaving sections of the external cutting member in radial directions as the external cutting member is rotated around its axis by a predetermined angle with a use of an index device. The differences in the length of the slit are obtained by changing the cutting angle of the rotary cutter relative to the external cutting member.

2 Claims, 3 Drawing Sheets

METHOD AND APPARATUS FOR MAKING EXTERNAL CUTTING MEMBER OF AN ELECTRIC RAZOR

BACKGROUND OF THE INVENTION

1. Field of the Invention

The present invention relates to a method and apparatus for making an external cutting member of an electric razor and more particularly to a method and apparatus for opening slits in the external cutting member of an electric razor.

2. Prior Art

Japanese Patent Application Publication (Kokoku) No. 41-14339 discloses an external cutting member for an electric razor that has two concentric circular shaving sections.

The external cutting member of this prior art has a partition groove that divides the shaving surface into inner and outer circular shaving sections. The partition groove is an angled-U-shape in cross section. The two shaving sections obtained by the partition groove are formed with many slits which open in a radial direction.

Since the partition groove that divides the shaving surface has sharp edges, pieces of hair and grease from the skin tend to accumulate in the partition groove, thus making it insanitary. In addition, the process for making the angled-U-shaped groove is troublesome.

Furthermore, the hair that enters into the partition groove may be bent when it comes into contact with the bottom of the groove. As a result, a smooth shaving is often hindered.

On the other hand, while the external cutting member as described above may be made by pressing, it is difficult to form the slits with high precision.

SUMMARY OF THE INVENTION

Accordingly, it is a primary object of the present invention to provide a method of making an external cutting member and more particularly to provide a method of opening slits in the external member, the slits being able to smoothly bring the hair thereinto.

It is still another object of the present invention to provide an apparatus for opening slits in an external cutting member that produces slits which can smoothly bring the hair thereinto.

The object of the present invention is accomplished by a unique method of opening slits in an external cutting member for an electric razor that takes the steps of:

(i) Bringing a rotary cutter into contact with a round shaving surface of an external cutting member, which has plural concentric sections divided by one or more concentric circular partition grooves, so as to open rectilinear first slits in a radial direction, the first slits crossing all the shaving sections and partition grooves; and (ii) Bringing the rotary cutter so as to come into contact with the shaving section(s) up to the innermost partition groove or up to the partition groove that is outside the innermost partition groove, thus opening the uneven length second and third slits between the first slits on the shaving surface.

In addition, the object of the present invention is accomplished by a unique structure for an apparatus that opens slits in an external cutting member for an electric razor, in which the shaving surface of the external cutting member is divided into plural sections via one or more circular partition grooves formed concentrically with the center of the shaving surface, and the apparatus comprises:

- a chuck unit that holds an external cutting member;
- an indexing unit that rotates the external cutting member, which is held by the chuck unit, about the axis of the cutting member by a specified angle at a time;
- a rotary cutter that opens rectilinear slits when brought into contact with the shaving surface of the external cutting member;
- a reciprocation mechanism that moves the rotary cutter to and away from the chuck unit which holds the external cutting member; and
- a vertical motion mechanism that adjust a vertical positional relationship between the rotary cutter and the external cutting member held by the chuck unit.

With the method and the structure described above, the uneven-lengths of slits are opened radially at appropriate intervals on the shaving surface ranging from the outermost shaving section to the innermost shaving section. Thus, the skin in contact with such an external cutting member is partially stretched out by the partition groove(s), and the hair is brought into the slits smoothly.

Also, when opening the slits in the external cutting member, the external cutting member, that has a round shaving surface divided into plural concentric sections via one or more circular concentric partition grooves, is held by the chuck unit; and the thus held external cutting member is rotated around its axis, with the use of the indexing unit, by a specified angle each time one slit is opened. By rotating the external cutting member in this manner, slits of a predetermined length are opened by the rotary cutter (for the entire shaving surface) that is brought into contact with the shaving surface such that the rotary cutter intersects the respective shaving sections as well as the partition groove(s). Furthermore, by changing the position of the contact point of the rotary cutter with the shaving surface of the external cutting member, slits of other lengths are formed on the shaving surface. Thus, slits of different lengths are easily opened in the external cutting member.

DESCRIPTION OF THE INVENTION

A detailed description of the present invention will be described below with reference to the accompanying drawings.

Figure 1:
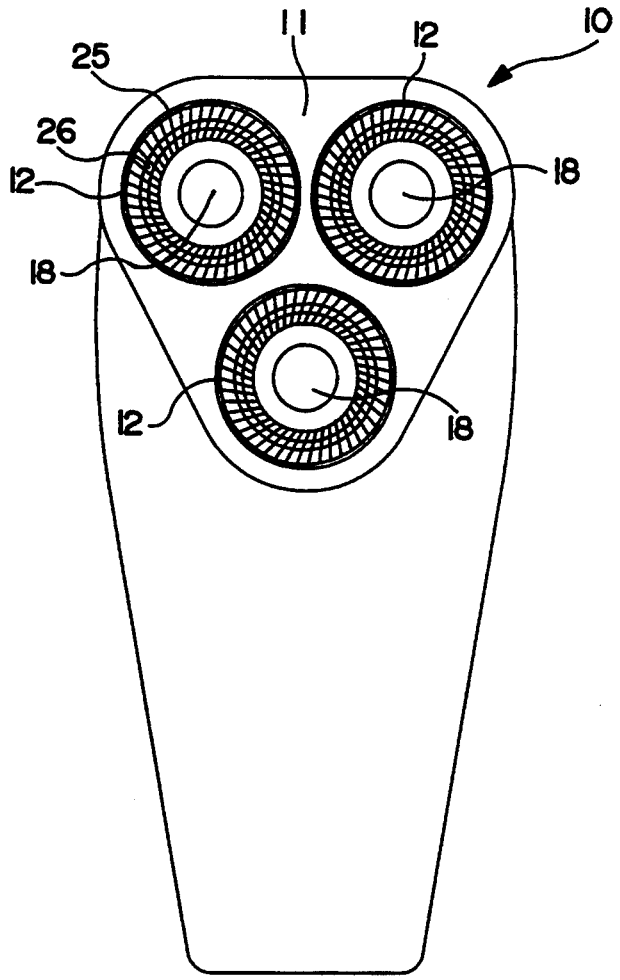
FIG. 1 is a front view of an electric razor with outer cutting members obtained by the method and apparatus of the present invention.

FIG. 1 shows an electric razor 10 with three external cutting members 12 which are obtained by the present invention and arranged in a reversed-triangle shape on the external-cutting member mount 11.

Figure 2:
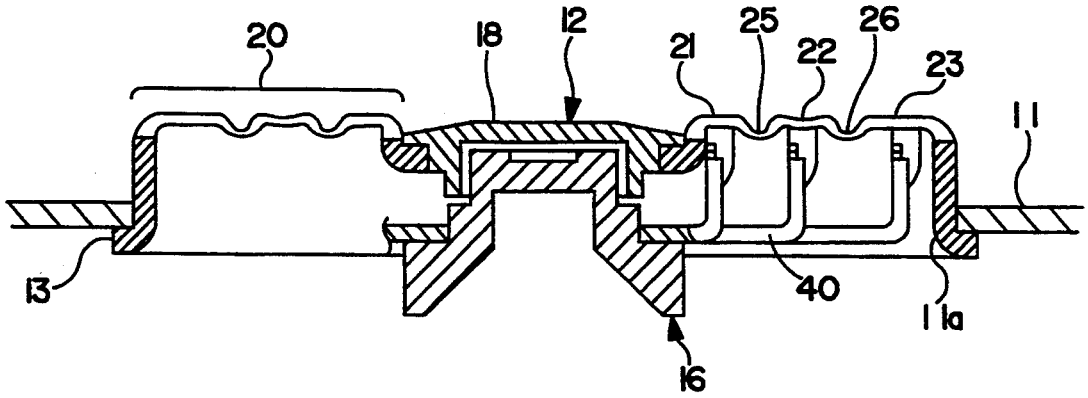
FIG. 2 is a sectional view illustrating the relationship between an internal cutting member and an external cutting member.

As shown in FIG. 2, the external cutting member 12 is in a shallow cup-shape as a whole. At the center of the external cutting member 12, a center cover 18 is affixed. The head of a drive transmission block 16 that is fixed to the center of an internal cutting member 40 is inserted in the center cover 18. The circumferential edge on the open side (or the underside) of the external cutting member 12 is provided with an outward flange 13. The flange 13 prevents the external cutting member 12 from coming out of the casing of the razor 10 after it is fitted into a through hole 11*a* from inside of the external cutting member mount 11.

The area that is not covered by the center cover 18 of the round top surface of the .external cutting member 12 is a shaving surface 20 that comes into contact with the skin when the shaving is performed. The shaving surface 20 is concentrically divided into three (in this embodiment) circular shaving sections. Starting from the one located closest to the center of the shaving surface 20, they are: an innermost shaving section 21, an intermediate shaving section 22, and an outermost shaving section 23. These shaving sections are divided (or partitioned) via two (in this embodiment) concentric circular partition grooves 25 and 26. The inner partition groove 25 and the outer partition groove 26 are the shallow U-shape depressions, which have round bottoms. They can also be shallow V-shape.

The shaving surface 20 is provided with uneven length slits that cross the shaving sections 21, 22 and 23 in different manners. Given below is a description of the slits.

Figure 3:
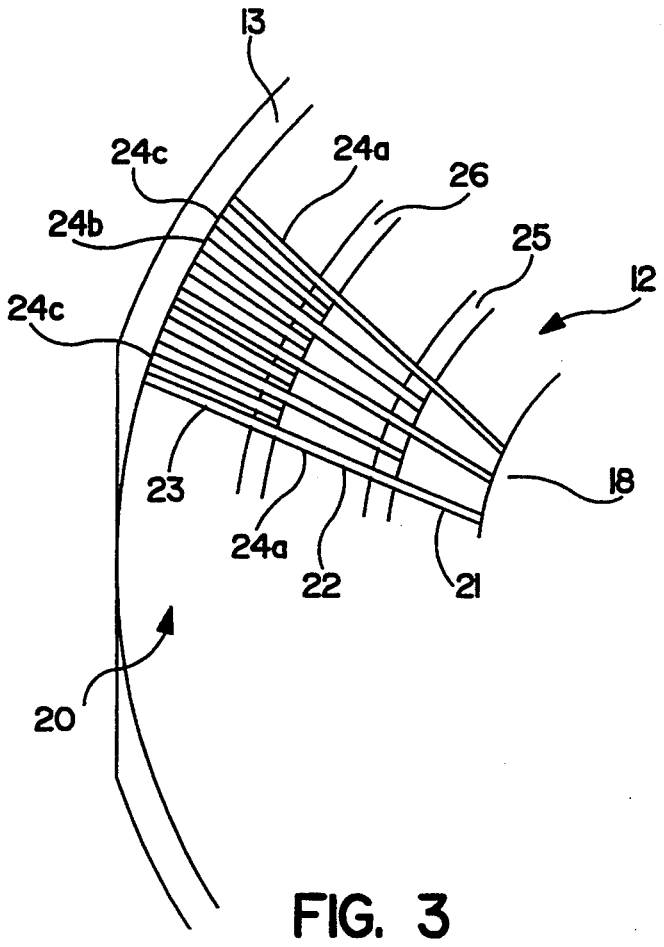
FIG. 3 is an enlarged partial top view of an external cutting member that is formed with uneven-lengths slits obtained by the method and apparatus of the present invention.

As seen in FIG. 3, three types of slits are opened in the radial direction. They differ in length so that they correspond to the number (three in this embodiment) of the circular shaving sections 21, 22 and 23.

The first slits 24*a* are radially laid out and cross all the three shaving sections 21, 22 and 23 and the two partition grooves 25 and 26. Thus, they are the longest among the three.

The second slits 24*b* are between two first slits 24*a*, and they are opened in the shaving sections 22 and 23 and in the partition grooves 25 and 26.

The third slits 24*c* are between the first slit 24*a* and the second slit 24*b* and opened in the outermost shaving section 23 and in the outer groove 26. Thus, they are the shortest among the three.

These slits 24*a*, 24*b* and 24*c* are formed circumferentially for the entire shaving surface 20. The ratio of the number of the slits on each one of the shaving sections 21, 22 and 23 is 1:2:4, when the number of the slits on the innermost shaving section 21 is one.

When the three shaving sections are compared with each other in its surface area, the innermost shaving section 21 which is on the center side or the innermost is the smallest, and the surface area increases as the location of the shaving section comes closer to the outer side. Accordingly, a larger number of slits are formed on the shaving sections located on the outer side.

Figure 4:
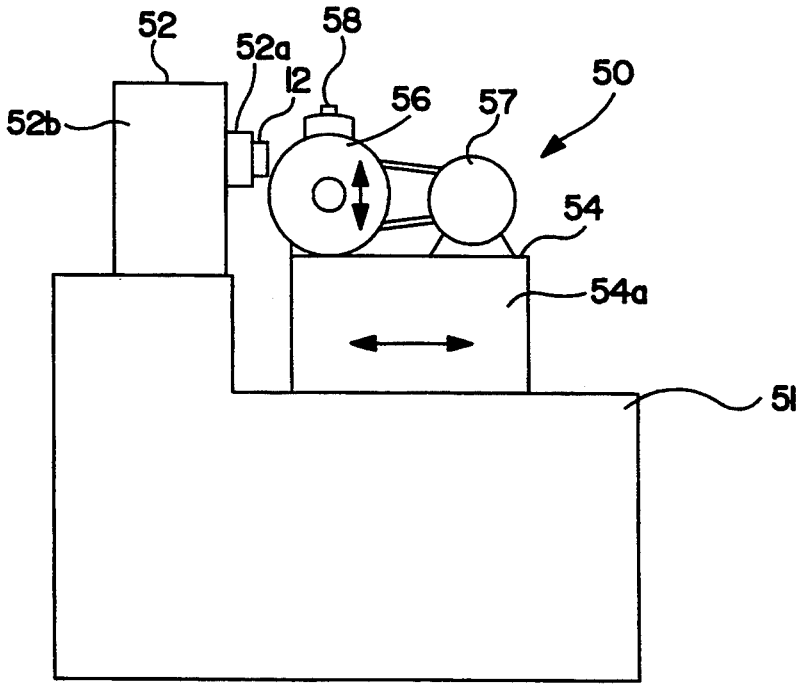
FIG. 4 is a schematic diagram of the apparatus for opening slits in the external cutting member according to the present invention.

FIG. 4 shows an apparatus for opening the slits seen above in the external cutting member 12.

The apparatus referred to by a reference numeral 50 includes a machine base 51, a chuck unit 52 for holding the external cutting member 12, and a cutting unit 54 for opening the slits in the shaving surface 20 of the external cutting member 2.

The chuck unit 52 comprises a chuck 52*a*, that is formed in a cap-shape and holds the external cutting member 12 that has a round shaving surface with a plurality of concentric circular shaving sections. The chuck unit 52 also has an indexing unit 52*b* for rotating the external cutting member 12 by a specified angle around its axis each time.

The cutting unit 54 comprises a cutter table 54*a*, a rotary cutter 56 mounted on the cutter table 54*a*, and a motor 57 for driving the rotary cutter 56. The cutter table 54*a* moves towards and away from the chuck unit 52 (as indicated by the horizontal arrow) by means of a reciprocation mechanism (not shown). The rotary cutter 56 can move vertically by means of a vertical movement mechanism 58 as shown by the vertical arrow.

The axis of the chuck 52*a* and the axis of the rotary cutter 56 are set at right angles relative to each other. Thus, the rotary cutter 56 is aligned in the radial direction of the shaving surface 20 of the cutting member 12 when the cutting member 12 is set on the chuck 52*a*.

Now a description will be given on the method of opening the slits in the external cutting member along with the operation of the slit opening apparatus. The explanation will be given for cases in which the second slits 24*b* are opened in the shaving sections 22 and 23 and only in the outer groove 26 and not in the inner groove 25 and in which the third slits 24*c* are opened in the outermost shaving section 23 only and not in the outer groove 26, being slightly different from the slits shown in FIG. 3.

When starting the opening of the slits in the shaving surface 20 of the external cutting member 12, the external cutting member 12 is first set in the chuck 52*a* of the chuck unit 52. The external cutting member 12 thus held by the chuck 52. The external cutting member 12 has the shaving surface 20 that is divided into three (in this embodiment) shaving sections 21, 22 and 23 with no slits opened in it yet.

The rotary cutter 56 is actuated to rotate by the motor 57 and moved toward the chucked external cutting member 12 by the cutter table 54*a* so as to come into contact with the shaving surface 20.

Figure 5:
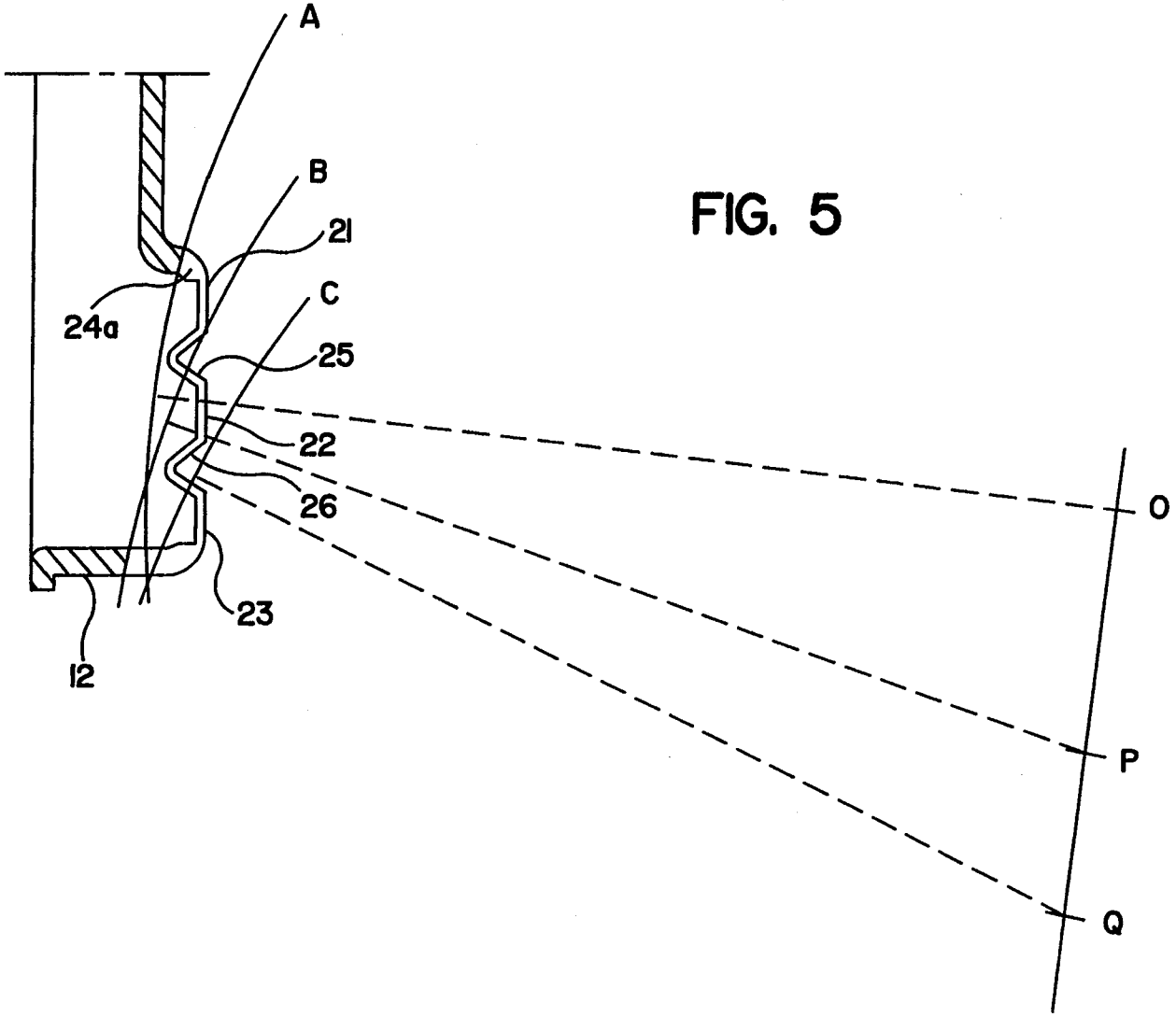
FIG. 5 illustrates the positional relationship between the rotary cutter used in the apparatus of FIG. 6 and the external cutting member at the time the slits are opened on the shaving surface of the external cutting member.

The first slits 24*a* which are the longest and cross all the shaving sections 21, 22 and 23 as well as the partition grooves 25 and 26 are opened first. One first slit 24*a* is opened by bringing the center of the rotary cutter 56 to the position O as shown in FIG. 5. In this case, the position of the outer edge of the rotary cutter is as shown by line A. Thus, the cutter 56 opens the first slits 24*a* by cutting the three shaving sections 21, 22 and 23 and two grooves 25 and 26 in the radial direction of the external cutting member.

Then, the external cutting member 12 held by the chuck 52*a* is rotated by a specified angle about its axis with the use of the indexing unit 52*b*, and in a like manner as described above, other first slits 24*a* are opened.

These steps are repeated so that first slits 24*a* are formed one after another circumferentially. The first slits 24*a* are thus opened in the entire shaving surface 20 with predetermined intervals.

Next, the second slits 24*b* are opened. The second slits 24*b* are cut in the shaving sections 22 and 23 and in the outer groove 26. Thus, the center of the rotary cutter 56 is set at the position P by adjusting the vertical movement mechanism 58 and the cutter table 54*a*. Thus, the edge of the rotary cutter 56 comes on the line B. In addition, the rotary cutter 56 is positioned between two of the previously opened first slits 24*a*.

One second slit 24*b* is opened in the shaving sections 22 and 23 and also in the partition groove 26 by the rotary cutter 56. After opening one second slit 24, the external cutting member 12 is rotated by a predetermined angle with the use of the indexing unit 52*b*, and another second slit 24 is opened between other two first slits 24*a*.

These steps are repeated so that a plurality of second slits 24*b* are opened radially in the shaving sections 22 and 23 and in the partition groove 26 and circumferentially between the two first slits 24*a*.

When opening the third slits 24*c*, the center of the rotary cutter 56 is brought to a position Q. Thus, the outer edge of the rotary cutter 56 is brought as shown by the line C. In this case, the cutter 56 is set between one of the first slits 24*a* and one of the second slits 24*b*, which are previously opened, and cuts and opens the third slits 24*c* in the ,outermost shaving section 23 in the same, manner as in the case of the first and second slits.

As seen from the above, according to the present invention, different lengths of radial direction slits are opened in the external cutting member of an electric razor. In addition, slits of any length can be opened by adjusting the vertical and horizontal relationship between the rotary cutter 56 and the external cutting member 12 that is held in the chuck unit 52.

In the above description, the shaving surface 20 has three or triple concentric circular sections. However, the method and the apparatus of the present invention can open the slits in the external cutting members that have a single circular section or double, quadruple, quintuple or more concentric circular sections.

Also, it is not necessary to open the slits in the order described above. By setting data of slits to be opened including the data of the length and depth of the slits in a computer, the method and the apparatus can be controlled so that they open the slits in any desired order such that the first, second and third slits are opened successively in this order and otherwise.

In addition, if the rotary cutter 56 is set so that it is off the center of the chuck 52*a* and therefore off the center of the chucked external cutting member 12, it is possible to open the slits that are off the center of the cutting member in a spiral arrangement. This can be done by tilting the rotary cutter so as to not be vertical. In fact, the external cutting member 12 shown in FIG. 3 is of this type.

It should be understood that the present invention is not limited to the embodiments described above. Various changes and modifications may be made without departing from the spirit and the scope of the invention.

As described above, the slits of the external cutting member of an electric razor are opened by a rotary cutter, and the slits can be different in length, and they are opened easily with high accuracy.

We claim:

1. A method for opening slits in an external cutting member, which is for an electric razor and has a plurality of concentric circular shaving sections on its round top surface which are divided by concentric circular partition grooves, comprising the steps of:

opening a first slit by cutting said concentric circular shaving sections and said partition grooves in a radial direction of said external cutting member by a rotary cutter;

rotating said external cutting member for a predetermined angle about an axis of said external cutting member;

opening another first slit, and repeating said steps of opening first slits circumferentially on said top surface of said external cutting member;

opening a second slit between two of said first slits by cutting less number of said circular shaving sections and outer ones of said partition grooves than in said first slits in the radial direction of said external cutting member by said rotary cutter;

rotating said external cutting member for a predetermined angle about the axis of said external cutting member;

opening another second slit, and repeating said steps of opening second slits circumferentially on said top surface of said external cutting member;

opening a third slit between one of said first slits and one of said second slits by cutting less number of circular shaving sections than in said second slits in the radial direction of said external cutting member by said rotary cutter;

rotating said external cutting member for a predetermined angle about the axis of said external cutting member; and opening another third slit, and repeating said steps of opening third slits circumferentially on said top surface of said external cutting member.

2. A method for opening slits in an external cutting member, which is for an electric razor and has three concentric circular shaving sections on its round top which are divided by inner and outer concentric circular partition grooves, comprising the steps of:

cutting a first slit on said three concentric circular shaving sections and said two partition grooves in a radial direction of said external cutting member with a rotary cutter to open said first slit, then rotating said external cutting member for a predetermined angle about an axis of said external cutting member, and cutting first slits circumferentially on a top surface of said external cutting member;

cutting a second slit on two outer ones of said circular shaving sections and said outer partition groove in a radial direction of said external cutting member with said rotary cutter to open said second slit between two of said first slits, then rotating said external cutting member for a predetermined angle about said axis of said external cutting member and cutting second slits circumferentially on said top surface of said external cutting member; and cutting a third slit on an outermost concentric circular shaving section in a radial direction of said external cutting member with said rotary cutter to open said third slit at a position between one of said first slits and one of said second slits, then rotating said external cutting member for a predetermined angle about said axis of said external cutting member, and cutting third slits circumferentially on said top surface of said external cutting member.

* * * * *